US006940521B2

(12) United States Patent
Suzuki et al.

(10) Patent No.: US 6,940,521 B2
(45) Date of Patent: Sep. 6, 2005

(54) GRAY SCALE PROCESSING SYSTEM AND DISPLAY DEVICE

(75) Inventors: Masahiro Suzuki, Yamanashi-ken (JP); Jun Kamiyamaguchi, Yamanashi-ken (JP); Tetsuya Shigeta, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 10/736,710

(22) Filed: Dec. 17, 2003

(65) Prior Publication Data

US 2004/0125117 A1 Jul. 1, 2004

(30) Foreign Application Priority Data

Dec. 24, 2002 (JP) ..... 2002-371878
Dec. 26, 2002 (JP) ..... 2002-376418

(51) Int. Cl.[7] ..... G09G 5/22
(52) U.S. Cl. ..... 345/596; 345/597; 345/606; 345/601; 345/602
(58) Field of Search ..... 345/596, 597, 345/606, 601, 602

(56) References Cited

FOREIGN PATENT DOCUMENTS

JP 2000-227778 A 8/2000
JP 2001-312244 A 11/2001

*Primary Examiner*—Matthew C. Bella
*Assistant Examiner*—Mike Rahmjoo
(74) *Attorney, Agent, or Firm*—Sughrue Mion, PLLC

(57) ABSTRACT

A display device with a dithering circuit is provided which can perform dithering on an input video signal without causing flicker and dither noise. A correction value is provided to reduce the difference (average error value) between an average value of brightness levels represented by pixel data corresponding to each of pixels in a pixel group and an average value of brightness levels represented by dither added pixel data corresponding to each of the pixels in the pixel group. This correction value is added to the dither added pixel data for correction. This prevents flicker from being produced even when the assignment of dither coefficients in the pixel group is changed in each field to reduce dither noise. Also provided is a gray scale processing system which can perform gray scale processing on an input video signal without causing problems such as flicker. Control is provided to the operation of a gray scale processing circuit that performs gray scale processing on the input video signal in response to the frequency of the input video signal. This makes it possible to prevent a problem such as flicker even when an input video signal of a relatively high frequency is supplied.

10 Claims, 15 Drawing Sheets

GRAY SCALE PROCESSING SYSTEM AND DISPLAY DEVICE

BACKGROUND OF THE INVENTION

1. Field of the Invention

The present invention relates to a display device having a dithering circuit and a gray scale processing system which performs gray scale processing on an input video signal.

2. Description of the Related Art

There is a known display device for displaying images which incorporates a gray scale processing circuit that performs gray scale processing on an input video signal to provide an increased number of pseudo-levels of gray scale.

For example, known as such a gray scale processing technique is a dithering technique in which four different dither coefficients "a" to "d" are each added to pixel data associated with each pixel in a set of four pixels that are adjacent to each other in the horizontal and vertical directions. For example, the dither coefficient "a" is added to the pixel data associated with the upper left pixel of the four pixels, the dither coefficient "b" is added to the pixel data associated with the upper right pixel, the dither coefficient "c" is added to the pixel data associated with the lower left pixel, and the dither coefficient "d" is added to the pixel data associated with the lower right pixel, respectively. However, in some cases, repeatedly adding the dither coefficients "a" to "d" to a screenful of pixel data in the aforementioned correspondence would cause a pseudo-pattern associated with the dither coefficients "a" to "d" to be perceived, i.e., a so-called dither noise would result.

In this context, another dithering technique was suggested in which the assignment of the dither coefficients "a" to "d" each to be added to pixel data associated with each of the four pixels adjacent to each other is changed for each field of an input video signal (e.g., see FIG. 8 in Japanese Patent Kokai No. 2001-312244; Patent Document 1). However, an addition operation according to this dithering technique may cause the average brightness level over the entire screen to vary from field to field, thus producing flicker.

A conventionally known display device for displaying images comprises a gray scale processing circuit which performs gray scale processing on an input video signal by error diffusion and dithering to provide an increased number of brightness levels for an image to be displayed on the screen (e.g., see FIGS. 24 to 27 in Japanese Patent Kokai No. 2000-227778; Patent Document 2).

In the error diffusion, for example, the input video signal is first converted to 8-bit pixel data associated with each pixel of the display, with the six high order bits being interpreted as display data and the remaining two least significant bits being interpreted as error data. Each error data of the aforementioned pixel data associated with each surrounding pixel is assigned a weight and added, thus allowing the resulting data to be reflected on the aforementioned display data. Such an operation allows the pseudo-brightness of the original pixel commensurate with the two least significant bits to be represented by the aforementioned surrounding pixels. Therefore, the display data of 6 bits being less than 8 bits makes it possible to represent the same levels of brightness as the aforementioned pixel data of 8 bits. The error diffusion pixel data of 6 bits obtained through the error diffusion is subjected to dithering.

In the dithering, a plurality of pixels adjacent to each other is defined as one pixel unit, and then different dither coefficients are each assigned to the aforementioned error diffusion pixel data associated with each pixel in the one pixel unit and then added, thereby providing dither added pixel data. In terms of the aforementioned one pixel unit, such an addition of the dither coefficients makes it possible to provide image data that enables only the four high order bits of the aforementioned dither added pixel data to represent the brightness corresponding to the 8 bits.

However, in some cases, the error diffusion and dithering performed on the input video signal as described above would result in a problem such as flicker.

SUMMARY OF THE INVENTION

The present invention has been developed to overcome the aforementioned problems. It is therefore an object of the present invention to provide a display device having a dithering circuit that can perform dithering on an input video signal without causing flicker and dither noise.

It is another object of the present invention to provide a gray scale processing system that can perform gray scale processing on an input video signal without causing problems such as flicker.

A display device according to a first aspect of the present invention displays an image in response to a video signal on a display screen having a plurality of display cells carrying pixels. The display device comprises: a dither coefficient generation component for generating a dither coefficient for each pixel group consisting of a plurality of the pixels corresponding to a location of each pixel in the pixel group; a dither adder for adding the dither coefficient to pixel data associated with each of the pixels in accordance with the video signal to obtain dither added pixel data; an average error computing component for determining, as an average error value, a difference between an average value of brightness levels represented by the pixel data associated with each of the pixels in the pixel group and an average value of brightness levels represented by the dither added pixel data associated with each of the pixels in the pixel group; a correction component for obtaining, as dithered pixel data, a result provided by adding a correction value for reducing the average error value to the dither added pixel data; and a display drive component for addressing the display in accordance with the dithered pixel data.

A gray scale processing system according to another aspect of the present invention is designed to increase the number of gray scale levels of image brightness expressed by a video signal. The gray scale processing system comprises: a frequency detector for detecting a frequency of the video signal; a gray scale processing circuit for performing gray scale processing on the video signal; and a gray scale process control component for controlling the operation of the gray scale processing circuit in response to the frequency.

A gray scale processing system according to further aspect of the present invention is designed to increase the number of gray scale levels of image brightness expressed by a video signal. The gray scale processing system comprises: a frequency detector for detecting a frequency of the video signal; a noise adding circuit for obtaining a noise added video signal by adding a noise signal to the video signal; a gray scale processing circuit for performing gray scale processing on the video signal; and a control component for controlling the operation of each of the gray scale processing circuit and the noise adding circuit in response to the frequency.

A display device according to a still further aspect of the present invention is designed to increase the number of gray scale levels of image brightness expressed by a video signal. The display device comprises: a frequency detector for detecting a frequency of the video signal; a gray scale processing circuit for performing gray scale processing on the video signal to generate a gray scaled video signal; a display component for displaying an image in response to the gray scaled video signal; and a gray scale process control component for controlling the operation of the gray scale processing circuit in response to the frequency.

DETAILED DESCRIPTION OF THE INVENTION

Now, the present invention will be explained below with reference to the accompanying drawings in accordance with the embodiments.

Figure 1:
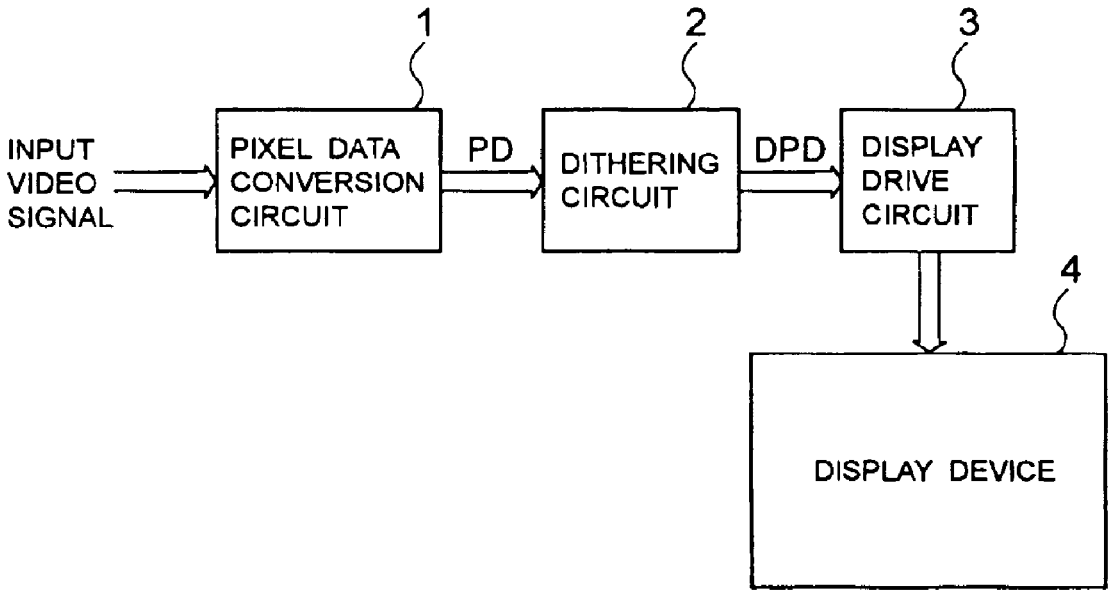
FIG. 1 is a schematic diagram illustrating the configuration of a display device incorporating a dithering circuit.

FIG. 1 is a schematic diagram illustrating the configuration of a display device according to the present invention.

Referring to FIG. 1, for example, a pixel data conversion circuit 1 converts an input video signal to pixel data PD of 8 bits for each pixel to supply the data to a dithering circuit 2. The dithering circuit 2 performs dithering (discussed later) on the pixel data PD to supply the resulting dithered pixel data DPD to a display drive circuit 3. The display drive circuit 3 produces various types of drive signals for addressing a display device 4 and supplies the signals to the display device 4 in accordance with the dithered pixel data DPD. The display device 4, comprising such as a CRT, a plasma display panel, a liquid crystal panel, or an electroluminescence display panel, displays an image corresponding to the aforementioned input video signal in response to the drive signals supplied by the aforementioned display drive circuit 3.

Figure 2:
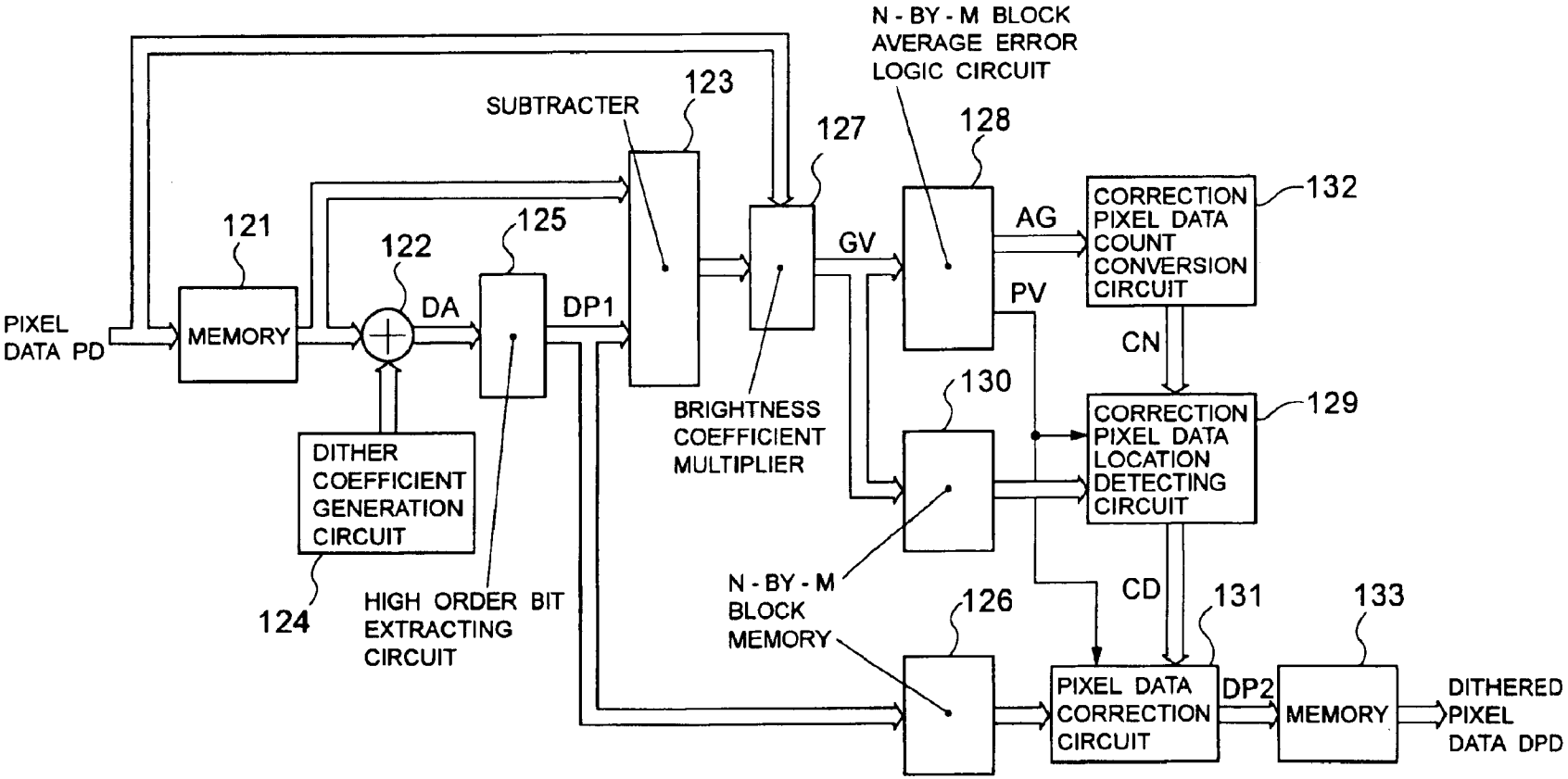
FIG. 2 is a diagram illustrating the configuration of the dithering circuit 2 shown in FIG. 1.

FIG. 2 is a diagram illustrating the internal configuration of the aforementioned dithering circuit 2.

Figure 3:
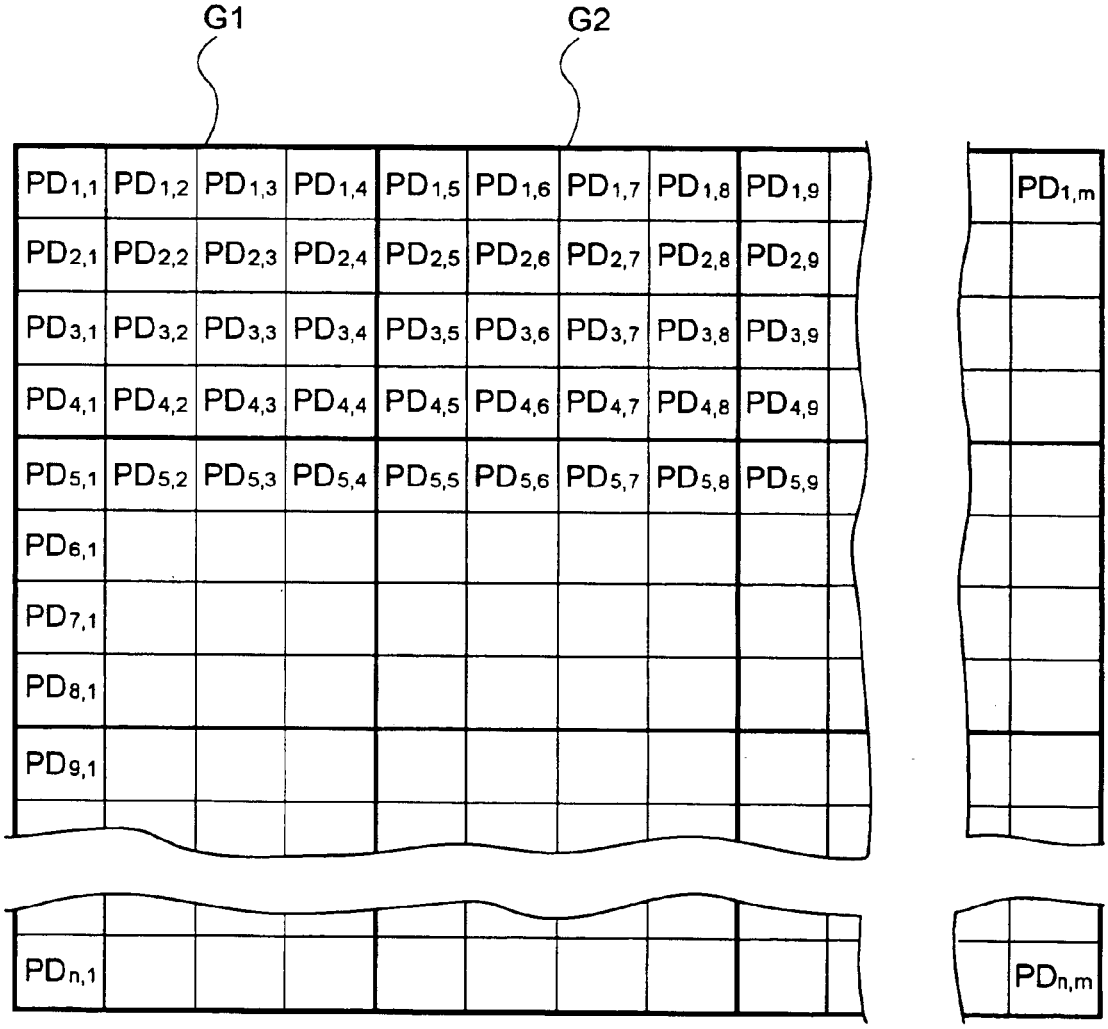
FIG. 3 is a diagram showing the relation between a four-row by four-column pixel block and pixel data PD.

Referring to FIG. 2, a memory 121 acquires the pixel data PD supplied by the pixel data conversion circuit 1, and then associates it with the location of each pixel on the screen of the display device 4 (n rows by m columns) for storage. Having stored a screenful of pixel data $PD_{1,1}$ to $PD_{n,m}$, the memory 121 sequentially reads the pixel data PD associated with each pixel in each n-row by m-column pixel block and then supplies the pixel data PD to an adder 122 and a subtractor 123. For example, for a four-row by four-column pixel block, the memory 121 first sequentially reads the pixel data $PD_{1,1}$ to $PD_{1,4}$, $PD_{2,1}$ to $PD_{2,4}$, $PD_{3,1}$ to $PD_{3,4}$, and $PD_{4,1}$ to $PD_{4,4}$, which belongs to a pixel block G1 encircled with a bold line in FIG. 3. The memory 121 then reads sequentially the pixel data $PD_{1,5}$ to $PD_{1,8}$, $PD_{2,5}$ to $PD_{2,8}$, $PD_{3,5}$ to $PD_{3,8}$, and $PD_{4,5}$ to $PD_{4,8}$, which belongs to a pixel block G2.

Figure 4:
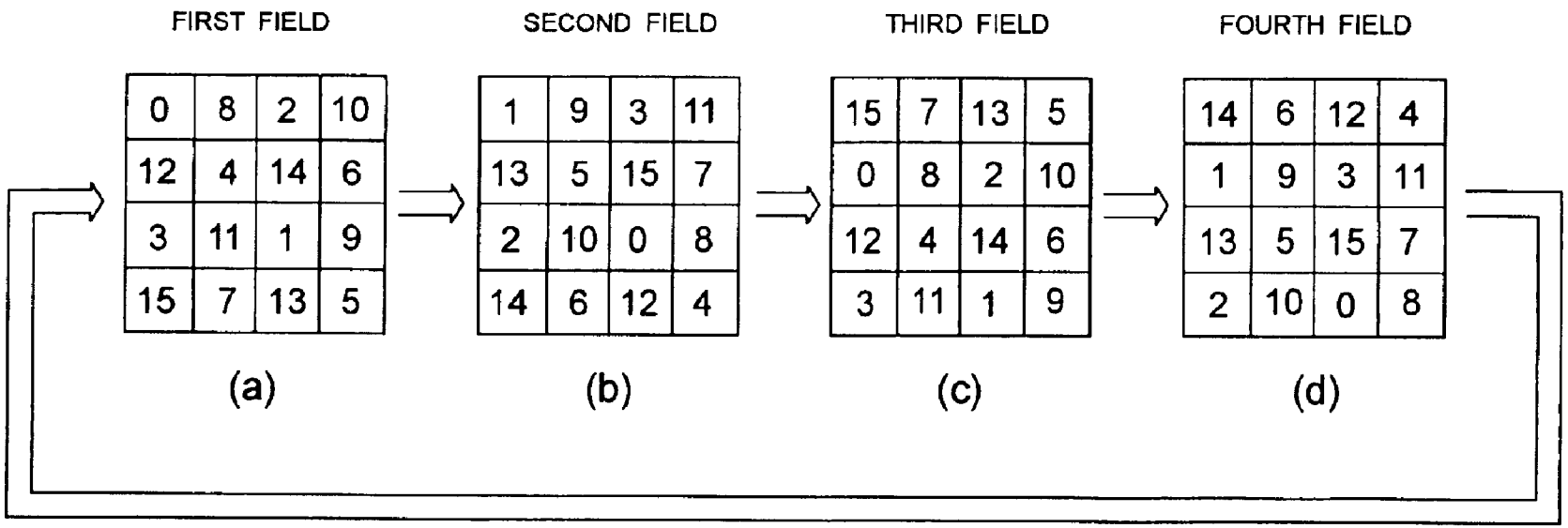
FIG. 4 is a diagram illustrating an exemplary assignment of dither coefficients in the four-row by four-column pixel block.

A dither coefficient generation circuit 124 generates (n by m) dither coefficients $A_{1,1}$ to $A_{n,m}$, having values different from each other, each associated with the location of each pixel in the n-row by m-column pixel block, and then supplies one by one the $A_{1,1}$ to $A_{1,m}$, $A_{2,1}$ to $A_{2,m}$, $A_{3,1}$ to $A_{3,m}$, . . . , and $A_{n,1}$ to $A_{n,m}$ to the adder 122 in that order. At this time, the dither coefficient generation circuit 124 changes each value of the dither coefficients $A_{1,1}$ to $A_{n,m}$ each time a screenful of pixel data PD is supplied, i.e., for each field. For example, for a four-row by four-column pixel block, each value of the dither coefficients $A_{1,1}$ to $A_{1,4}$, $A_{2,1}$ to $A_{2,4}$, $A_{3,1}$ to $A_{3,4}$, and $A_{4,1}$ to $A_{4,4}$ changes as shown in FIG. 4(*a*) in the beginning first field, as shown in FIG. 4(*b*) in the subsequent second field, as shown in FIG. 4(*c*) in the third field, and as shown in FIG. 4(*d*) in the fourth field. In FIG. 4, the values of the dither coefficients are all represented in decimal notation.

The adder 122 adds the dither coefficients A supplied by the dither coefficient generation circuit 124 and the pixel data PD read on the memory 121 to obtain the resulting dither added pixel data DA of 8 bits, which is in turn supplied to a high order bit extracting circuit 125. That is, the adder 122 sequentially adds the pixel data $PD_{1,1}$ to $PD_{n,m}$ in the n-row by m-column pixel block and the aforementioned dither coefficients $A_{1,1}$ to $A_{n,m}$, each pair of pixel data PD and dither coefficient A being associated with the same pixel location. Then, the adder 122 sequentially supplies each of the resulting dither added pixel data $DA_{1,1}$ to $DA_{n,m}$ thus obtained to the high order bit extracting circuit 125.

The high order bit extracting circuit 125 samples only a group of predetermined high order bits from the dither added pixel data DA to supply it to the subtractor 123 and an n-by-m block memory 126 as first dithered pixel data DP1. Here, the group of the predetermined high order bits is a group of contiguous high order bits including the most significant bit in the dither added pixel data DA, and the number of those bits depends on the minimum number of bits that is required to represent each of the aforementioned dither coefficients $A_{1,1}$ to $A_{n,m}$ in binary. For example, the dither coefficients $A_{1,1}$ to $A_{4,4}$ shown in FIG. 4 are "0" to "15" (in decimal notation) and thus require 4 bits to represent them in binary notation. Therefore, in this case, the aforementioned high order bit extracting circuit 125 excludes the four least significant bits from the dither added pixel data DA to define the group of the remaining high order bits as the first dithered pixel data DP1. At this time, the brightness level represented by the first dithered pixel data DP1 is obtained by multiplying the DP1 by a brightness coefficient of "16". For example, the DP1 being 4-bit data of "0, 1, 1, 0" would represent a brightness level of "96" (in decimal notation).

The subtractor 123 subtracts the pixel data PD read on the memory 121 from the aforementioned first dithered pixel data DP1 to thereby determine the difference therebetween, and then supplies the value of the difference to a brightness coefficient multiplier 127. That is, the subtractor 123 determines the difference between the brightness level represented by the pixel data PD and that represented by the first dithered pixel data DP1 obtained by performing dithering on the pixel data PD. The brightness coefficient multiplier 127 multiplies the value of the difference by a coefficient corresponding to the brightness level represented by the aforementioned pixel data PD to supply the resulting value to an n-by-m block average error logic circuit 128 and an n-by-m block memory 130 as an error value GV indicative of the final difference in brightness between the pixel data PD and the first dithered pixel data DP1.

The n-by-m block memory 126 sequentially stores the first dithered pixel data DP1 supplied by the high order bit extracting circuit 125. Then, having stored each of the first dithered pixel data $DP1_{1,1}$ to $DP1_{n,m}$ associated with the n-row by m-column pixel block, the n-by-m block memory 126 reads each of the first dithered pixel data $DP1_{1,1}$ to $DP1_{n,m}$, for example, in the order of $DP_{1,1}$ to $DP_{1,m}$, $DP_{2,1}$ to $DP_{2,m}$, $DP_{3,1}$ to $DP_{3,m}$, . . . , and $DP_{n,1}$ to $DP_{n,m}$ to supply these pieces of data to a pixel data correction circuit 131.

On the other hand, the n-by-m block memory 130 sequentially stores the error values GV supplied by the brightness coefficient multiplier 127. Then, having stored each of the error values $GV_{1,1}$ to $GV_{n,m}$ associated with the n-row by m-column pixel block, the n-by-m block memory 130 reads each of the error values $GV_{1,1}$ to $GV_{n,m}$, for example, in the order of $GV_{1,1}$ to $GV_{1,m}$, $GV_{2,1}$ to $GV_{2,m}$, $GV_{3,1}$ to $GV_{3,m}$, . . . , and $GV_{n,1}$ to $GV_{n,m}$ to supply those error values to a correction pixel data location detection circuit 129.

Each time the error values $GV_{1,1}$ to $GV_{n,m}$ associated with the n-row by m-column pixel block are supplied by the brightness coefficient multiplier 127, the n-by-m block average error logic circuit 128 determines the average value of these error values $GV_{1,1}$ to $GV_{n,m}$ to supply the resulting value to a correction pixel data count conversion circuit 132 as an average error value AG.

The correction pixel data count conversion circuit 132 converts the average error value AG to a count of the first dithered pixel data DP1 to be corrected and then supplies a correction pixel data count CN representative of the count to the correction pixel data location detection circuit 129. That is, the correction pixel data count conversion circuit 132 determines the count of the first dithered pixel data DP1 to be corrected in each n-row by m-column pixel block in accordance with the aforementioned average error value AG. At this time, the larger the average error value AG, the greater the correction pixel data count CN becomes.

The correction pixel data location detection circuit 129 first selects the error values GV by the count indicated by the aforementioned correction pixel data count CN from each of the error values $GV_{1,1}$ to $GV_{n,m}$ associated with the n-row by m-column pixel block supplied by the n-by-m block memory 130 in descending absolute value order. When an error value GV having the same location as that of the selected error value GV in the n-row by m-column pixel block is read on the aforementioned n-by-m block memory 130, the correction pixel data location detection circuit 129 supplies a correction signal CD of logic level "1" for instructing to make a correction at that timing to the pixel data correction circuit 131. Otherwise, the correction pixel data location detection circuit 129 supplies a correction signal CD of logic level "0" to the pixel data correction circuit 131.

When having been supplied with a correction signal CD of logic level "0", the pixel data correction circuit 131 supplies the first dithered pixel data DP1 read sequentially on the n-by-m block memory 126 as it is to a memory 133 as second dithered pixel data DP2. On the other hand, when having been supplied with a correction signal CD of logic level "1", the pixel data correction circuit 131 corrects the first dithered pixel data DP1 with a correction value corresponding to a polarity signal PV indicative of the polarity of the average error value AG, the polarity signal PV being delivered by the aforementioned n-by-m block average error logic circuit 128 and supplied via the correction pixel data location detection circuit 129. The pixel data correction circuit 131 then supplies the resulting data as the second dithered pixel data DP2 to the memory 133. For example, when the average error value AG is indicative of the negative polarity, the pixel data correction circuit 131 adds a correction value of "1" to the first dithered pixel data DP1 to supply the resulting data as the second dithered pixel data DP2 to the memory 133. That is, when the average brightness of the n-row by m-column pixel block provided by the first dithered pixel data DP1 after dithering is lower than that of the n-row by m-column pixel block provided by the pixel data PD before dithering, the pixel data correction circuit 131 adds "1" to the first dithered pixel data DP1 in order to increase the average brightness. On the other hand, when the average error value AG is indicative of the positive polarity, the pixel data correction circuit 131 adds a correction value of "−1" to the first dithered pixel data DP1 to supply the resulting data as the second dithered pixel data DP2 to the memory 133. That is, when the average brightness of the n-row by m-column pixel block provided by the first dithered pixel data DP1 after dithering is higher than that of the n-row by m-column pixel block provided by the pixel data PD before dithering, the pixel data correction circuit 131 subtracts "1" from the first dithered pixel data DP1 in order to decrease the average brightness.

The memory 133 sequentially acquires each second dithered pixel data DP2 supplied by the pixel data correction circuit 131 for each n-by-m block to store the second dithered pixel data DP2 corresponding to the location of each pixel on the screen (n rows by m columns) of the display device 4. Then, each time a screenful of second dithered pixel data DP2 is stored, the memory 133 sequentially reads the second dithered pixel data DP2 for each display line to supply the data DP2 as the final dithered pixel data DPD to the aforementioned display drive circuit 3.

Now, by way of example, the operation of the dithering circuit 2 will be described below in which dithering is performed on the pixel data PD for each four-row by four-column pixel block.

Figure 5:
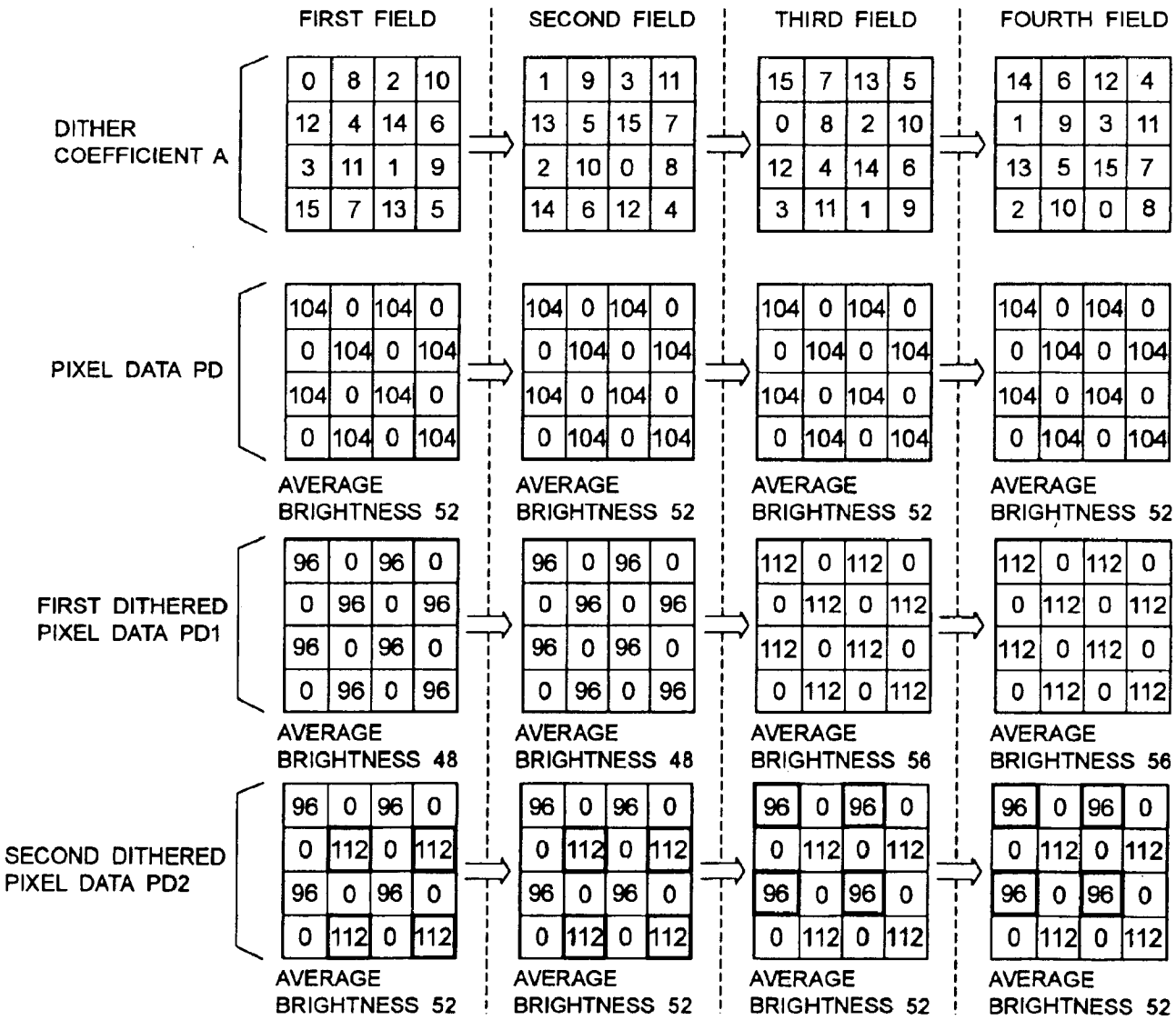
FIG. 5 is a diagram illustrating an example of first dithered pixel data DP1 and second dithered pixel data DP2 generated in accordance with the pixel data PD.

FIG. 5 is a diagram illustrating an extract of only one pixel block, showing the progression of each of the pixel data PD, the first dithered pixel data DP1 after dithering, and the second dithered pixel data DP2.

FIG. 5 also illustrates an operation in which entered is a video signal having an image pattern that allows the pixel data PD indicative of a brightness level of "104" (in decimal notation) and the pixel data PD indicative of a brightness level of "0" to appear in a checkerboard pattern in the four-row by four-column pixel block.

The dither coefficient generation circuit 124 generates 16 dither coefficients of "0" to "15" (in decimal notation) while changing the locations assigned in the four-row by four-column pixel block for each field as shown in FIG. 5. Thus, each pixel data PD in the four-row by four-column pixel block and the aforementioned dither coefficient are added at the adder 122, and the high order bits of the resulting value excluding the four least significant bits are sampled to provide the first dithered pixel data DP1 representative of the following brightness levels in each of the first to fourth fields.

That is, as shown in FIG. 5, in each of the first and second fields, obtained is the first dithered pixel data DP1 indicative of brightness levels of "96" and "0" (in decimal notation) in the four-row by four-column pixel block. For example, since the pixel data PD is "104" at the first row and the first column in the first field, adding a dither coefficient of "0" at the first row and the first column to it yields "104" as well. The "104" can be represented as [0, 1, 1, 0, 1, 0, 0, 0] in a binary number of 8 bits, with the high order bits being [0, 1, 1, 0] excluding the four least significant bits. That is, it is possible to obtain the first dithered pixel data DP1 of [0, 1, 1, 0] indicative of a brightness level of "96". On the other hand, a dither coefficient of "8" at the first row and the second column is added to the pixel data PD being "0" at the first row and the second column in the first field to yield "8". The "8" is represented as [0, 0, 0, 0, 1, 0, 0, 0] in a binary number of 8 bits, with the four high order bits being [0, 0, 0, 0] excluding the four least significant bits. That is, it is possible to obtain the first dithered pixel data DP1 of [0, 0, 0, 0] indicative of a brightness level of "0". In this case, the average value represented by each first dithered pixel data DP1 in the four-row by four-column pixel block is "48".

On the other hand, as shown in FIG. 5, in each of the third and fourth fields, obtained is the first dithered pixel data DP1 indicative of brightness levels of "112" and "0" (in decimal notation) in the four-row by four-column pixel block. For example, a dither coefficient of "15" at the first row and the first column is added to the pixel data PD being "104" at the first row and the first column in the third field to yield "119". The "119" is represented as [0, 1, 1, 1, 0, 1, 1, 1] in a binary number of 8 bits, with the high order bits being [0, 1, 1, 1] excluding the four least significant bits. That is, it is possible to obtain the first dithered pixel data DP1 of [0, 1, 1, 1] indicative of a brightness level of "112". On the other hand, a dither coefficient of "7" at the first row and the second column is added to the pixel data PD being "0" at the first row and the second column in the third field to yield "7". The "7" is represented as [0, 0, 0, 0, 0, 1, 1, 0] in a binary number of 8 bits, with the four high order bits being [0, 0, 0, 0] excluding the four least significant bits. That is, it is possible to obtain the first dithered pixel data DP1 of [0, 0, 0, 0] indicative of a brightness level of "0". At this time, the average value represented by each first dithered pixel data DP1 in the four-row by four-column pixel block is "56".

Accordingly, an image displayed using the first dithered pixel data DP1 would provide an average brightness of "48" in the respective first and second fields while providing average brightness of "56" in the respective third and fourth fields. Therefore, the variation in the average brightness from the first to the fourth fields would result in flicker.

In this context, the flicker is prevented using the subtractor 123 shown in FIG. 2, the n-by-m block memories 126 and 130, the n-by-m block average error logic circuit 128, the correction pixel data location detection circuit 129, the pixel data correction circuit 131, and the correction pixel data count conversion circuit 132.

That is, the difference between each pixel data PD in the n-row by m-column pixel block and the aforementioned first dithered pixel data DP1 associated with the position of the pixel is determined as an error value GV. Then, the average of the error values GV in the n-row by m-column pixel block is determined as the average error value AG. Then, the count of the first dithered pixel data DP1 to be corrected in the n-row by m-column pixel block is determined as the correction pixel data count CN in accordance with the average error value AG. Subsequently selected is the first dithered pixel data DP1 to be corrected from each first dithered pixel data DP1 in the n-row by m-column pixel block by the count indicated by the correction pixel data count CN in the descending order of the absolute value of the error value GV determined according to the DP1. A correction value corresponding to the polarity of the average error value AG determined according to the DP1 is added to the first dithered pixel data DP1 selected to produce the second dithered pixel data DP2, which is delivered as the final dithered pixel data.

For example, according to the aforementioned operation, in the first and second fields shown in FIG. 5, the average value of the respective first dithered pixel data DP1 in the pixel block is "48" while the average value of the respective pixel data PD is "52". Thus, by a count of "4" corresponding to the difference therebetween, each first dithered pixel data DP1 assigned to the locations encircled in a bold line is corrected. That is, since the first and second fields have the maximum error between the first dithered pixel data DP1 indicative of a brightness level of "96" and the pixel data PD indicative of a brightness level of "104", only four pieces of the respective first dithered pixel data DP1 indicative of "96" are corrected. At this time, since the first dithered pixel data DP1 is less than the pixel data PD, a correction value of "1" is added to the first dithered pixel data DP1 of [0, 1, 1, 0] indicative of a brightness level of "96" to be corrected to provide the second dithered pixel data DP2 of [0, 1, 1, 1] indicative of a brightness level of "112". This correction results in an average value of "52" of the respective second dithered pixel data DP2 in the pixel block of the respective first and second fields. On the other hand, since the third and fourth fields shown in FIG. 5 have an average value of "52" of the respective pixel data PD in the pixel block and an average value of "56" of the respective first dithered pixel data DP1. Thus, by a count of "4" being the difference therebetween, each first dithered pixel data DP1 assigned to the locations encircled in a bold line is corrected. That is, since the third and fourth fields have the maximum error between the first dithered pixel data DP1 indicative of "112" and the pixel data PD indicative of "104", only four pieces of the respective first dithered pixel data DP1 indicative of "112" are corrected. In this case, since the first dithered pixel data DP1 is greater than the pixel data PD, a correction value of "1" is subtracted from the first dithered pixel data DP1 to be corrected to provide the second dithered pixel data DP2 of [0, 1, 1, 0] indicative of a brightness level of "96". This correction results in an average value of "52" of the respective second dithered pixel data DP2 in the pixel block of the respective third and fourth fields.

Therefore, no flicker will result because the average value of the respective second dithered pixel data DP2 in the pixel block from the first to the fourth fields is kept at "52".

As described above, the dithering circuit 2 shown in FIG. 2 corrects the pixel data after dithering so that the average value of the pixel data (DP1) after dithering is equal to that of the pixel data (PD) before dithering. This allows a good flicker-free image to be displayed even when dither coefficients are assigned in the n-row by m-column pixel block differently in each field in order to reduce dither noise.

Now, the present invention will be explained below with reference to the accompanying drawings in accordance with other embodiments.

Figure 6:
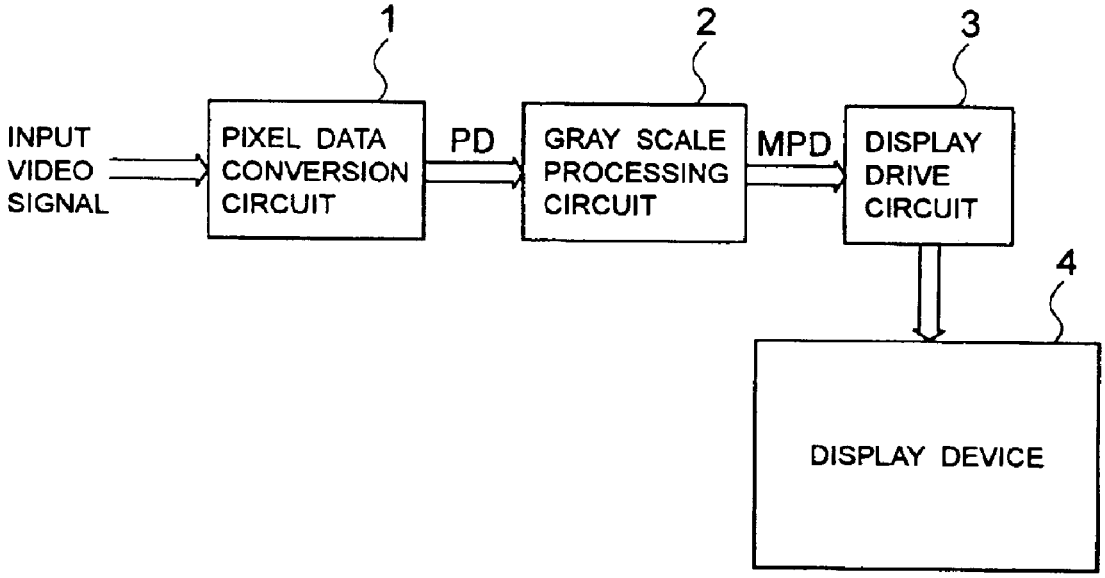
FIG. 6 is a schematic diagram illustrating the configuration of a display device incorporating a gray scale processing circuit.

FIG. 6 is a schematic view illustrating the configuration of a display device incorporating a gray scale processing system according to the present invention.

Referring to FIG. 6, for example, a pixel data conversion circuit 1 converts an input video signal to pixel data PD of 8 bits for each pixel to supply the data to a dithering circuit 20. The dithering circuit 20 performs gray scale processing by the error diffusion and dithering on the pixel data PD to supply the resulting dithered pixel data MPD to a display drive circuit 3. The display drive circuit 3 produces various types of drive signals for addressing a display device 4 and supplies the signals to the display device 4 in accordance with the dithered pixel data MPD. The display device 4, comprising such as a CRT, a plasma display panel, a liquid crystal panel, or an electroluminescence display panel, displays an image corresponding to the aforementioned input video signal in response to the drive signals supplied by the aforementioned display drive circuit 3.

Figure 7:
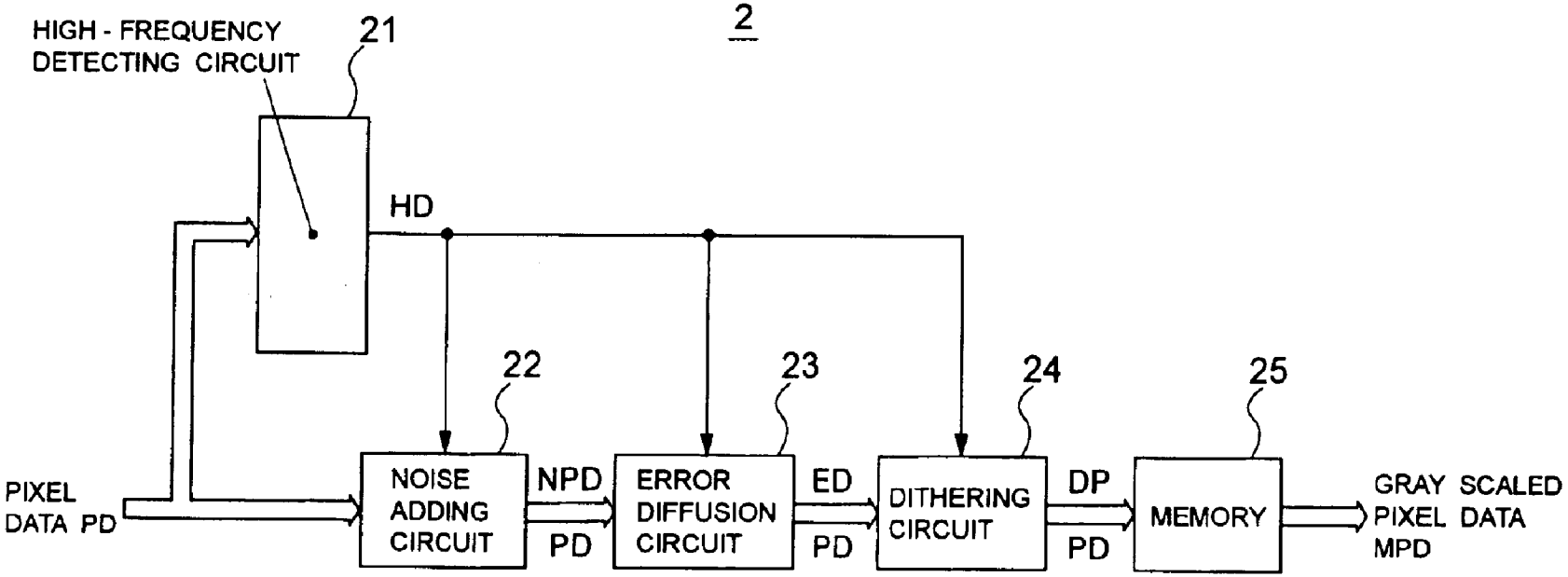
FIG. 7 is a diagram illustrating the internal configuration of the gray scale processing circuit 20 shown in FIG. 6.

FIG. 7 is a view illustrating the internal configuration of the gray scale processing circuit 20.

Referring to FIG. 7, a high-frequency detection circuit 21 senses the frequency of an input video signal in accordance with the aforementioned pixel data PD in order to produce a high-frequency detection signal HD of logic level "1" when the frequency is higher than a predetermined frequency or a high-frequency detection signal HD of logic level "0" when the frequency is lower than the predetermined frequency. Then, the high-frequency detection circuit 21 supplies the high-frequency detection signal HD of logic level "1" or "0" to each of a noise adding circuit 22, an error diffusion circuit 23, and a dithering circuit 24.

Figure 8:
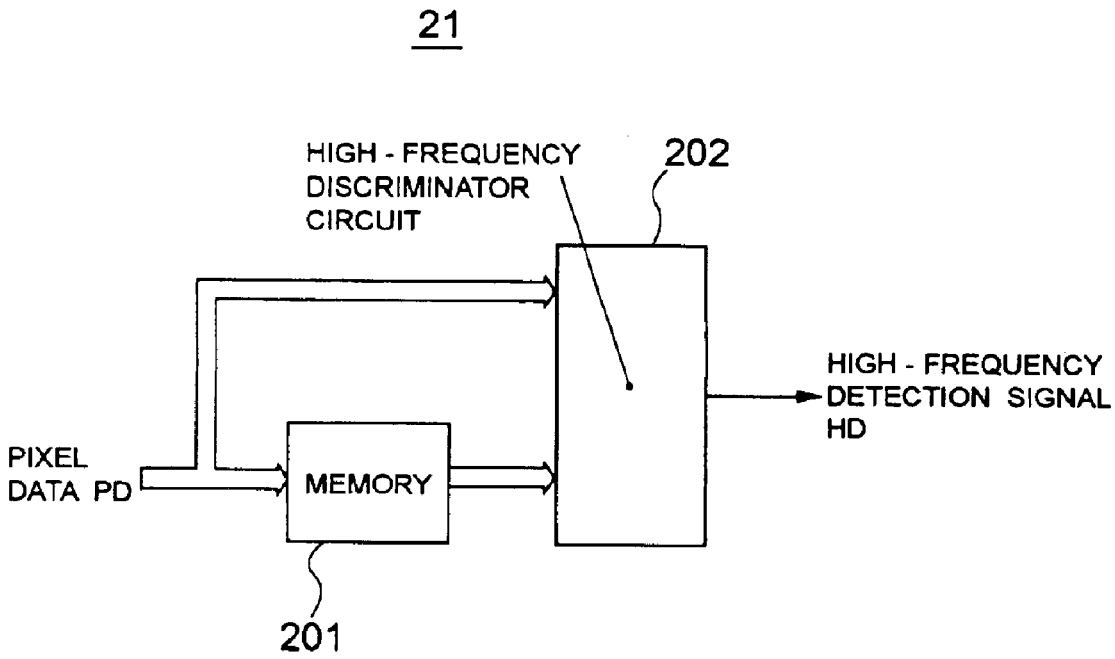
FIG. 8 is a diagram illustrating the internal configuration of the high-frequency detection circuit 21 shown in FIG. 7.

FIG. 8 is a view illustrating an example of the internal configuration of the high-frequency detection circuit 21.

Referring to FIG. 8, a memory 201 sequentially acquires the pixel data PD supplied by the pixel data conversion circuit 1. Then, each time one display line of the display device 4 is completely acquired, the memory 201 reads the pixel data PD in the order at which the pixel data PD has been acquired to supply the pixel data PD to a high-frequency discriminator circuit 202. That is, the high-frequency discriminator circuit 202 is supplied with the pixel data PD associated with each of two display lines adjacent to each other. For example, in accordance with the pixel data PD associated with each of the display lines adjacent to each other, the high-frequency discriminator circuit 202 first determines, for each two-row by four-column pixel block G encircled in a bold line of FIG. 3, a total sum X of the absolute values of the differences between the pieces of pixel data PD associated with the pixels adjacent horizontally and vertically to each other in the pixel block. For example, the aforementioned total sum X is determined as follows for the pixel block G1 shown in FIG. 4.

$$X = |PD_{1,1} - PD_{1,2}| + |PD_{1,2} - PD_{1,3}| + |PD_{1,3} - PD_{1,4}| +$$

-continued $$|PD_{2,1} - PD_{2,2}| + |PD_{2,2} - PD_{2,3}| + |PD_{2,3} - PD_{2,4}| +$$

$$|PD_{2,1} - PD_{1,1}| + |PD_{2,2} - PD_{1,2}| + |PD_{2,3} - PD_{1,3}| + |PD_{2,4} - PD_{1,4}|.$$

Then, the high-frequency discriminator circuit 202 determines that the input video signal has a high frequency when the aforementioned total sum X is greater than a predetermined value to yield a high-frequency detection signal HD of logic level "1", while determining that the input video signal has a low frequency when the total sum X is less than the predetermined value to yield a high-frequency detection signal HD of logic level "0". The high-frequency discriminator circuit 202 then supplies the high-frequency detection signal HD of logic level "1" or "0" to each of the noise adding circuit 22, the error diffusion circuit 23, and the dithering circuit 24.

Figure 9:
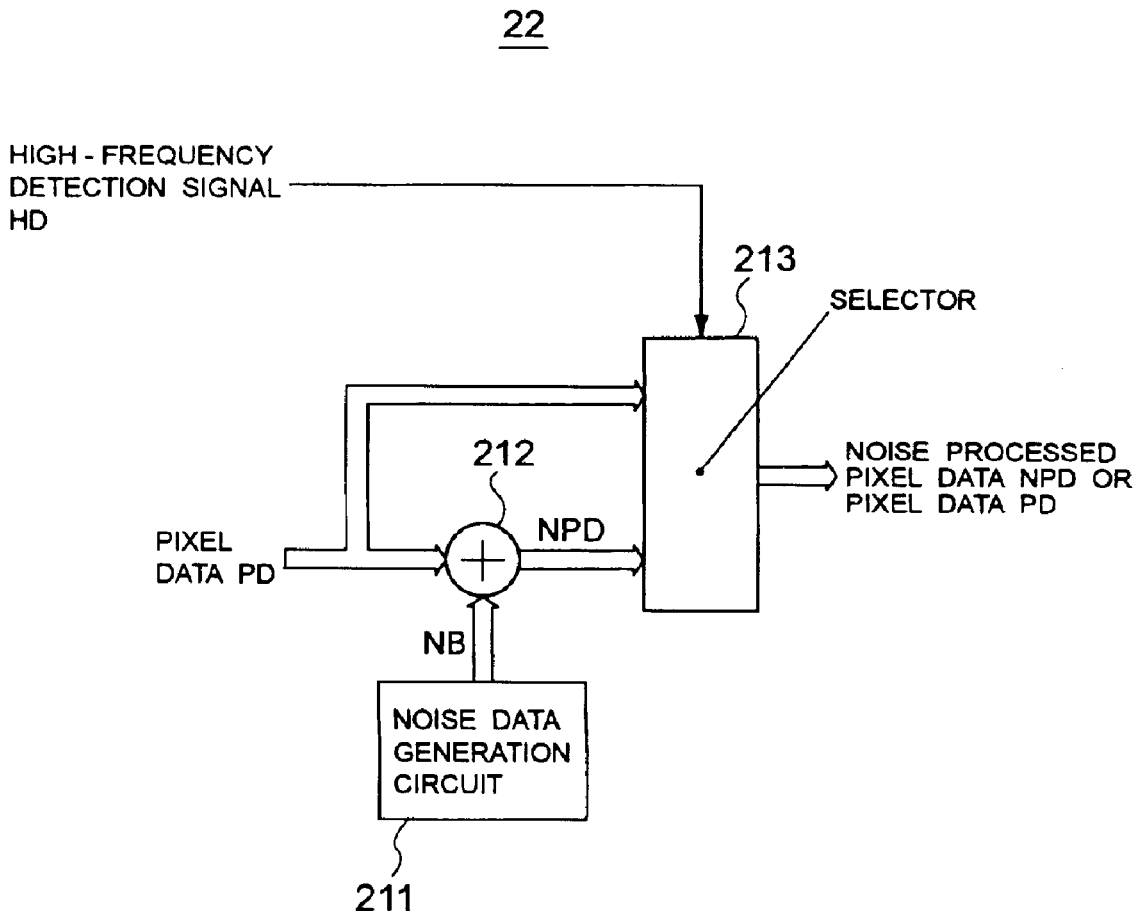
FIG. 9 is a diagram illustrating the internal configuration of the noise adding circuit 22 shown in FIG. 7.

FIG. 9 is a view illustrating an example of the internal configuration of the noise adding circuit 22.

As shown in FIG. 9, the noise adding circuit 22 comprises a noise data generation circuit 211, an adder 212, and a selector 213. For example, the noise data generation circuit 211, comprising a random number generator, supplies a bit of generated random data to the adder 212 as a noise data bit NB. The adder 212 adds the aforementioned noise data bit NB to the pixel data PD supplied by the pixel data conversion circuit 1 to supply the resulting data to the selector 213 as the noise processed pixel data NPD. The selector 213 supplies the aforementioned noise processed pixel data NPD to the error diffusion circuit 23 at the following stage when the high-frequency detection signal HD of logic level "0" is supplied by the high-frequency detection circuit 21, while supplying the aforementioned pixel data PD as it is to the error diffusion circuit 23 when the high-frequency detection signal HD of logic level "1" is supplied.

In such an arrangement, when the input video signal has a lower frequency than the predetermined frequency, the noise adding circuit 22 supplies to the error diffusion circuit 23 the noise processed pixel data NPD obtained by adding a noise component to the aforementioned pixel data PD. On the other hand, when the input video signal has a higher frequency than the predetermined frequency, the noise adding circuit 22 supplies the pixel data PD as it is to the error diffusion circuit 23 without adding any noise component thereto.

Figure 10:
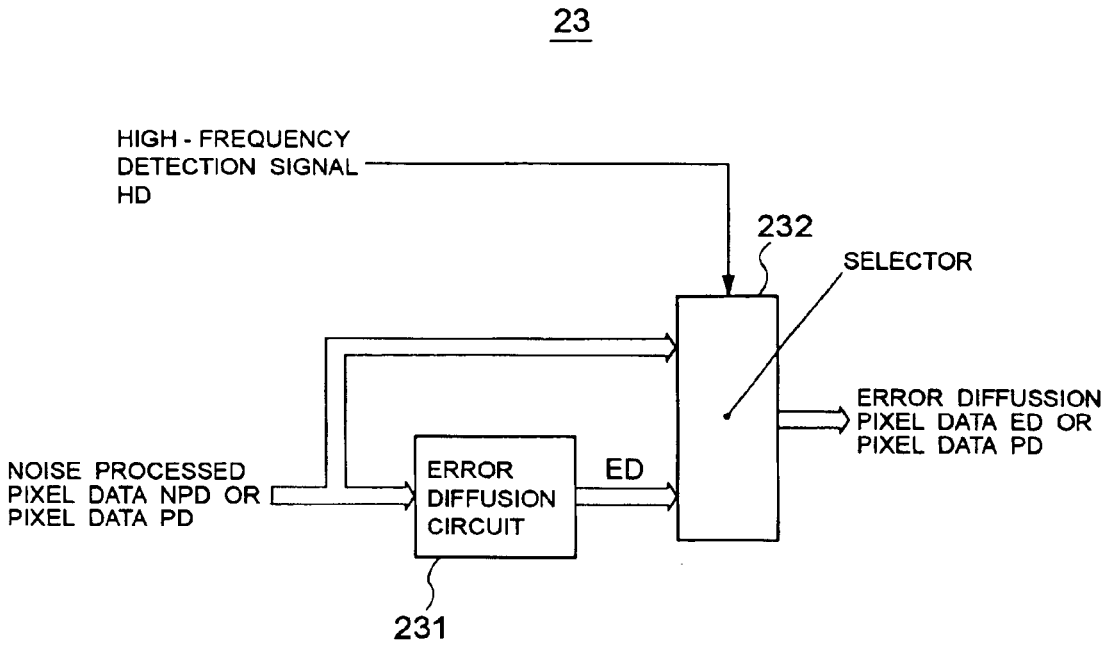
FIG. 10 is a diagram illustrating the internal configuration of the error diffusion circuit 23 shown in FIG. 7.

FIG. 10 is a view illustrating an example of the internal configuration of the error diffusion circuit 23.

Figure 11:
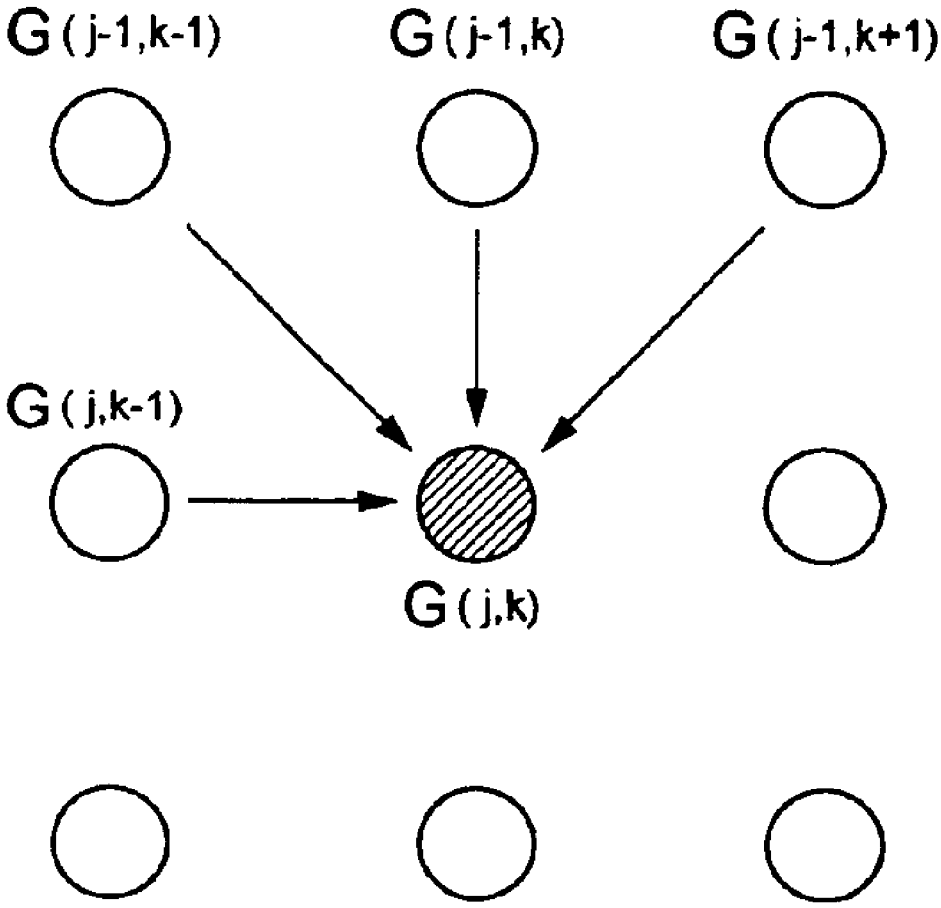
FIG. 11 is a schematic diagram illustrating error diffusion performed by the error diffusion circuit 23 shown in FIG. 7.

As shown in FIG. 10, the error diffusion circuit 23 comprises an error diffusion circuit 231 and a selector 232. The error diffusion circuit 231 first acquires pixel data from a stream of the pixel data (NPD or PD) supplied by the noise adding circuit 22, corresponding to each of pixels G(j, k), G(j, k−1), G(j−1, k−1), G(j−1, k), and G(j−1, k+1), which are arranged as shown in FIG. 11. Then, the groups of the least significant bits (low-brightness components) of the pixel data (NPD or PD) corresponding to the respective pixels G(j, k−1), G(j−1, k+1), G(j−1, k), and G(j−1, k−1) are weighted and added. The result obtained by the weighting and addition operations is reflected upon the group of the high order bits (high-intensity components) of the pixel data (NPD or PD) corresponding to the pixel G(j, k), and the resulting data is supplied to the selector 232 as the error diffusion pixel data ED. When having been supplied with the high-frequency detection signal HD of a logic level "0" by the high-frequency detection circuit 21, the selector 232 supplies the aforementioned error diffusion pixel data ED to the dithering circuit 24. On the other hand, when having been supplied with the high-frequency detection signal HD of a logic level "1", the selector 232 supplies to the dithering circuit 24 the pixel data supplied by the noise adding circuit 22. Since the selector 232 is supplied with the pixel data PD by the noise adding circuit 22 during the high-frequency detection signal HD being in the logic level "1", the selector 232 supplies the aforementioned pixel data PD as it is to the dithering circuit 24 during that period of time.

When the input video signal does not have a higher frequency than a predetermined frequency, the aforementioned arrangement allows the error diffusion circuit 23 to supply to the dithering circuit 24 the error diffusion pixel data ED obtained by performing error diffusion on the aforementioned noise processed pixel data NPD. On the other hand, when the input video signal has a higher frequency than the predetermined frequency, the error diffusion circuit 23 supplies the aforementioned pixel data PD as it is to the dithering circuit 24 without performing the error diffusion as mentioned above.

Figure 12:
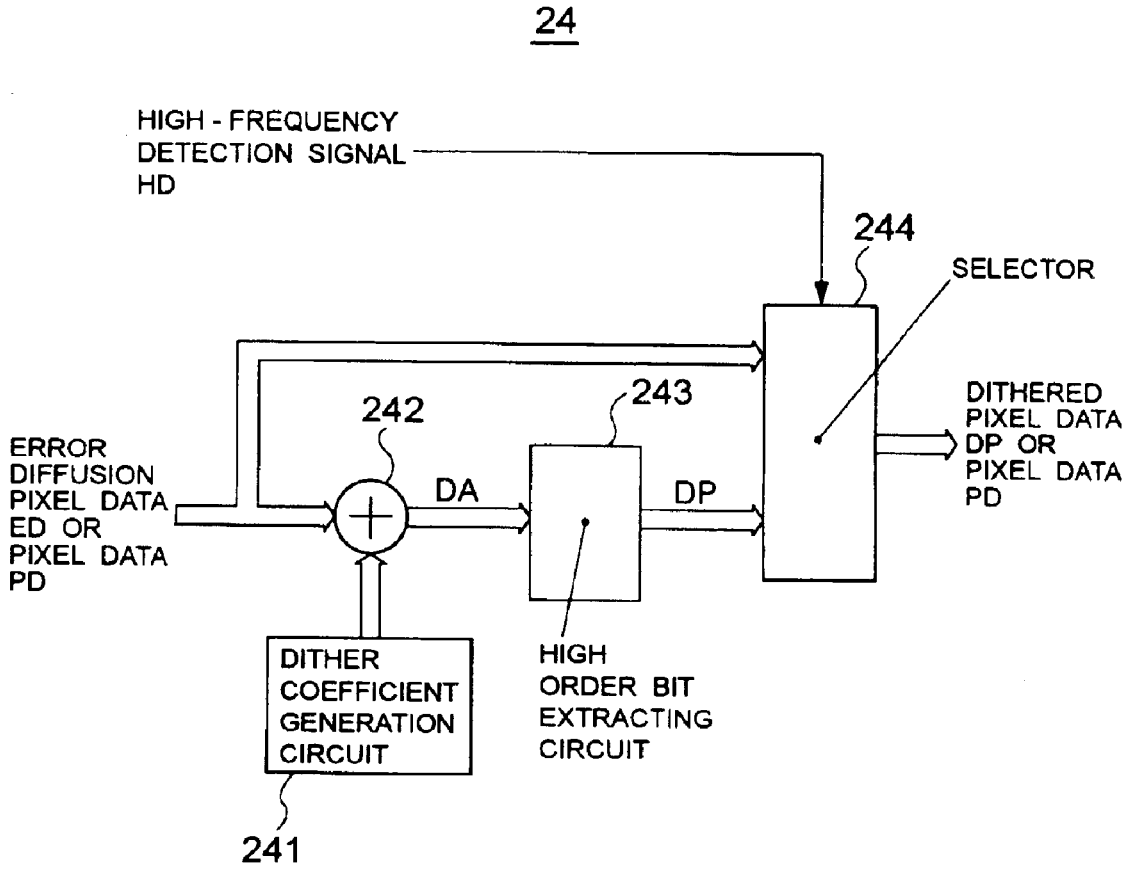
FIG. 12 is a diagram illustrating the internal configuration of the dithering circuit 24 shown in FIG. 7.

FIG. 12 is a view illustrating an example of the internal configuration of the dithering circuit 24 described above.

Figure 13:
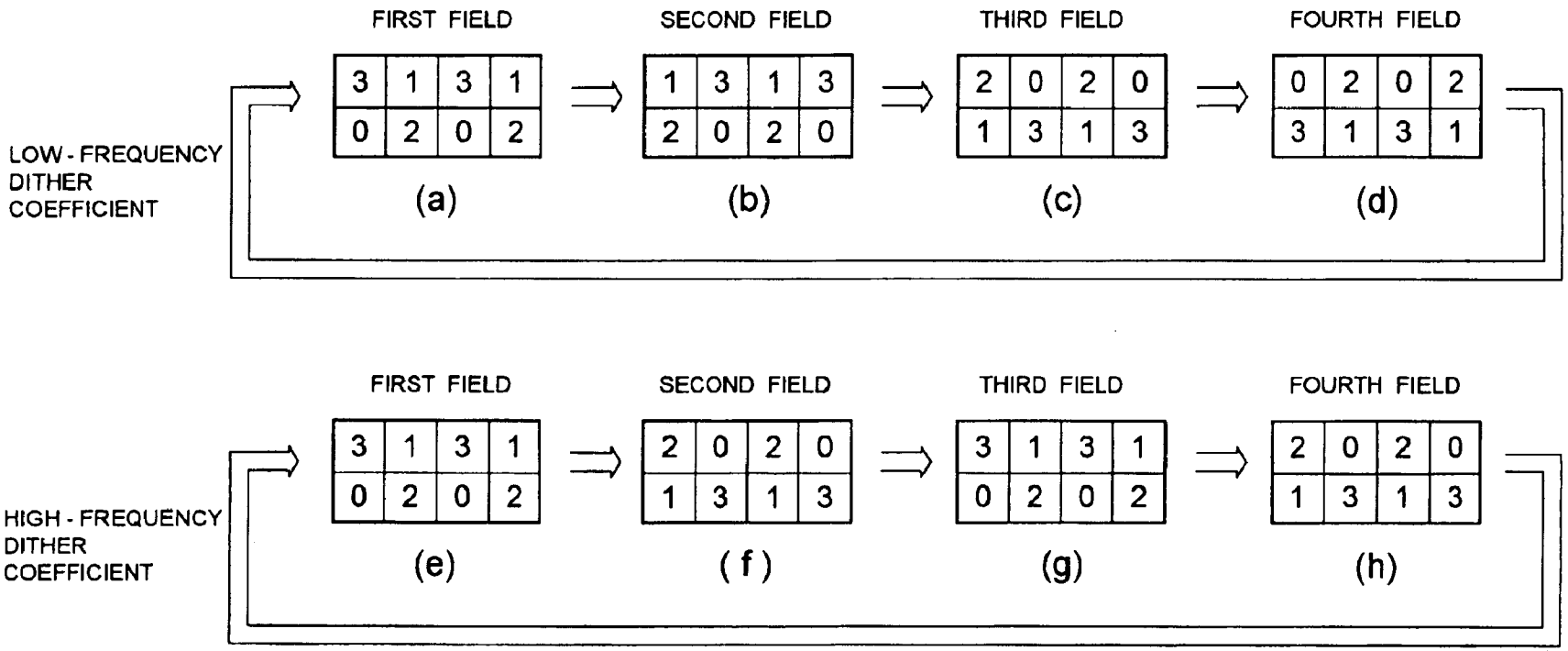
FIG. 13 is a diagram illustrating dither coefficients assigned in progression in a two-row by four-column pixel block in a first to fourth field.

As shown in FIG. 12, the dithering circuit 24 comprises a dither coefficient generation circuit 241, an adder 242, a high order bit extracting circuit 243, and a selector 244. The dither coefficient generation circuit 241 generates (n by m) dither coefficients $A_{1,1}$ to $A_{n,m}$ each corresponding to the location of each pixel in the n-row by m-column pixel block, and then sequentially supplies the dither coefficients to the adder 242. At this time, the dither coefficient generation circuit 241 changes each value of the dither coefficients $A_{1,1}$ to $A_{n,m}$ in each one field (or one frame) of the input video signal. For example, for a two-row by four-column pixel block, suppose that each value of the dither coefficients $A_{1,1}$ to $A_{1,4}$ and $A_{2,1}$ to $A_{2,4}$ in the beginning first field is as shown in FIG. 13(*a*). In this case, each value of the dither coefficients is changed as shown in FIG. 13(*b*) in the subsequent second field, as shown in FIG. 13(*c*) in the third field, and as shown in FIG. 13(*d*) in the fourth field. The adder 242 adds the pixel data (the error diffusion pixel data ED or the pixel data PD) supplied by the aforementioned error diffusion circuit 23 and the dither coefficients "A" each corresponding to the location of the pixel data in the pixel block. The adder 242 then supplies the resulting data to the high order bit extracting circuit 243 as the dither added pixel data DA. The high order bit extracting circuit 243 samples only a group of the predetermined high order bits from the dither added pixel data DA to supply it to the selector 244 as the dithered pixel data DP. When having been supplied with the high-frequency detection signal HD of logic level "0" by the high-frequency detection circuit 21, the selector 244 supplies the aforementioned dithered pixel data DP to a memory 25 at the following stage. On the other hand, when having been supplied with the high-frequency detection signal HD of logic level "1", the selector 244 supplies to the memory 25 the pixel data supplied by the aforementioned error diffusion circuit 23. Since the selector 244 is supplied with the pixel data PD by the error diffusion circuit 23 during the high-frequency detection signal HD being in the logic level "1", the selector 244 supplies the aforementioned pixel data PD as it is to the memory 25 during that period of time.

When the input video signal does not have a higher frequency than a predetermined frequency, the aforementioned arrangement allows the dithering circuit 24 to supply to the memory 25 the dithered pixel data DP obtained by performing dithering on the error diffusion pixel data ED. On the other hand, when the input video signal has a higher frequency than the predetermined frequency, the dithering circuit 24 supplies the aforementioned pixel data PD as it is to the memory 25 without performing the dithering as mentioned above.

The memory 25 acquires the dithered pixel data DP or the pixel data PD supplied by the dithering circuit 24 to store the data corresponding to the location of each pixel on the screen (n rows by m columns) of the display device 4. Then, each time a screenful of pixel data (DP or PD) is stored, the memory 25 sequentially reads the pixel data for each display line to supply the data as the dithered pixel data MPD to the aforementioned display drive circuit 3.

As described above, the dithering circuit 2 shown in FIG. 7 performs gray scale processing (error diffusion and dithering) on an input video signal only when the input video signal is less in frequency than the predetermined frequency. That is, the present applicant recognized that flicker was produced by the gray scale processing being performed on a so-called high-frequency input video signal when supplied, the input video signal causing relatively frequent variations in the brightness provided by pixel data associated with each of pixels adjacent to each other. For this reason, the applicant decided not to perform gray scale processing on the input video signal when supplied.

Such a design makes it possible to display a good image without causing any problems such as flicker.

The dithering circuit 24 according to the aforementioned embodiment is to perform no dithering when the input video signal is higher in frequency than the predetermined frequency, however, the dither coefficients to be added may be changed depending on the frequency of the input video signal.

Figure 14:
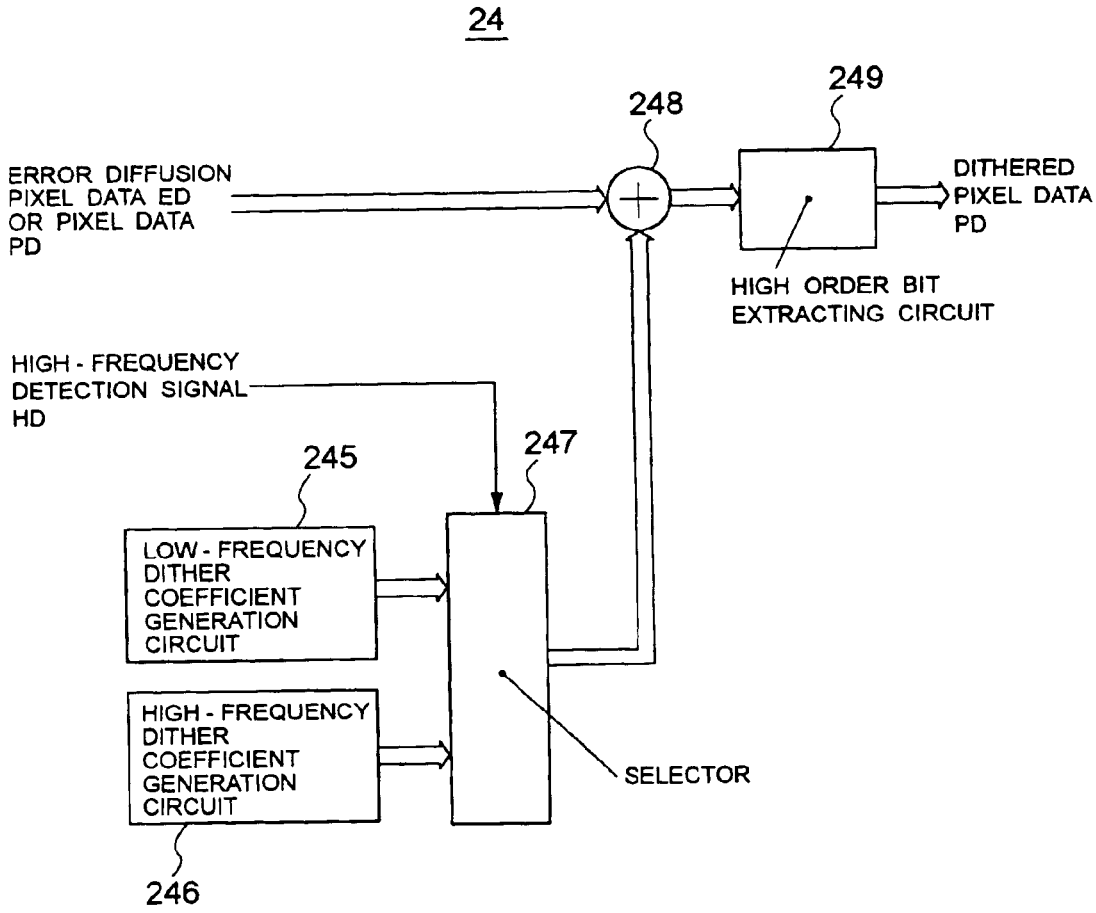
FIG. 14 is a diagram illustrating another configuration of the dithering circuit 24 shown in FIG. 7.

FIG. 14 is a view illustrating another example of the internal configuration of the dithering circuit 24 which was developed in view of such a point.

The dithering circuit 24 shown in FIG. 14 comprises a low-frequency dither coefficient generation circuit 245, a high-frequency dither coefficient generation circuit 246, a selector 247, an adder 248, and a high order bit extracting circuit 249. The low-frequency dither coefficient generation circuit 245 generates (n by m) dither coefficients $A_{1,1}$ to $A_{n,m}$ each corresponding to the location of each pixel in the n-row by m-column pixel block, and then sequentially supplies the dither coefficients to the selector 247. In this process, the low-frequency dither coefficient generation circuit 245 changes each value of the dither coefficients $A_{1,1}$ to $A_{n,m}$ in each one field (or one frame) of an input video signal. For example, for a two-row by four-column pixel block, each value of the dither coefficients $A_{1,1}$ to $A_{1,4}$ and $A_{2,1}$ to $A_{2,4}$ is changed so as to be as shown in the part (a) of FIG. 13 in the beginning first field, as shown in the part (b) of FIG. 13 in the second field, as shown in the part (c) of FIG. 13 in the third field, and as shown in the part (d) of FIG. 13 in the fourth field. That is, the low-frequency dither coefficient generation circuit 245 changes each value of the dither coefficients $A_{1,1}$ to $A_{1,4}$ and $A_{2,1}$ to $A_{2,4}$ in each field so that dithering is performed on an input video signal having a relatively low frequency without causing dither noise.

The high-frequency dither coefficient generation circuit 246 generates (n by m) dither coefficients $B_{1,1}$ to $B_{n,m}$ each corresponding to the location of each pixel in the n-row by m-column pixel block, and then sequentially supplies the dither coefficients to the selector 247. At this time, the high-frequency dither coefficient generation circuit 246 changes each value of the dither coefficients $B_{1,1}$ to $B_{n,m}$ in each one field (or one frame) of the input video signal. For example, for a two-row by four-column pixel block, each value of the dither coefficients $B_{1,1}$ to $B_{1,4}$ and $B_{2,1}$ to $B_{2,4}$ is changed so as to be as shown in the part (e) of FIG. 13 in the beginning first field, as shown in the part (f) of FIG. 13 in the second field, as shown in the part (g) of FIG. 13 in the third field, and as shown in the part (h) of FIG. 13 in the fourth field. That is, the high-frequency dither coefficient generation circuit 246 changes each value of the dither coefficients $B_{1,1}$ to $B_{1,4}$ and $B_{2,1}$ to $B_{2,4}$ in each field so that dithering is performed on an input video signal having a relatively high frequency without causing flicker.

When having been supplied with the high-frequency detection signal HD of logic level "0" by the high-frequency detection circuit 21, the selector 247 supplies to the adder 248 the dither coefficients $A_{1,1}$ to $A_{n,m}$ supplied by the low-frequency dither coefficient generation circuit 245. On the other hand, when having been supplied with the high-frequency detection signal HD of logic level "1" by the high-frequency detection circuit 21, the selector 247 supplies to the adder 248 the dither coefficients $B_{1,1}$ to $B_{n,m}$ supplied by the high-frequency dither coefficient generation circuit 246. The adder 248 adds the pixel data (the error diffusion pixel data ED or the pixel data PD) supplied by the aforementioned error diffusion circuit 23 and the dither coefficients ($A_{1,1}$ to $A_{n,m}$ or $B_{1,1}$ to $B_{n,m}$) each associated with the location of the pixel data in the pixel block, and then supplies the resulting data to the high order bit extracting circuit 249 as the dither added pixel data DA. The high order bit extracting circuit 249 samples only a group of the predetermined high order bits from the dither added pixel data DA and then supplies the resulting data to the aforementioned memory 25 as the dithered pixel data DP.

That is, when the input video signal is lower in frequency than the predetermined frequency, the dithering circuit 24 shown in FIG. 14 adds the low-frequency dither coefficients "A", which change as shown in the part (a) to the part (d) of FIG. 13, to the pixel data, thereby providing the dithered pixel data DP. On the other hand, when the input video signal is higher in frequency than the predetermined frequency, the high-frequency dither coefficients "B", which change as shown in the part (e) to the part (h) of FIG. 13, to the pixel data, thereby providing the dithered pixel data DP.

Figure 15:
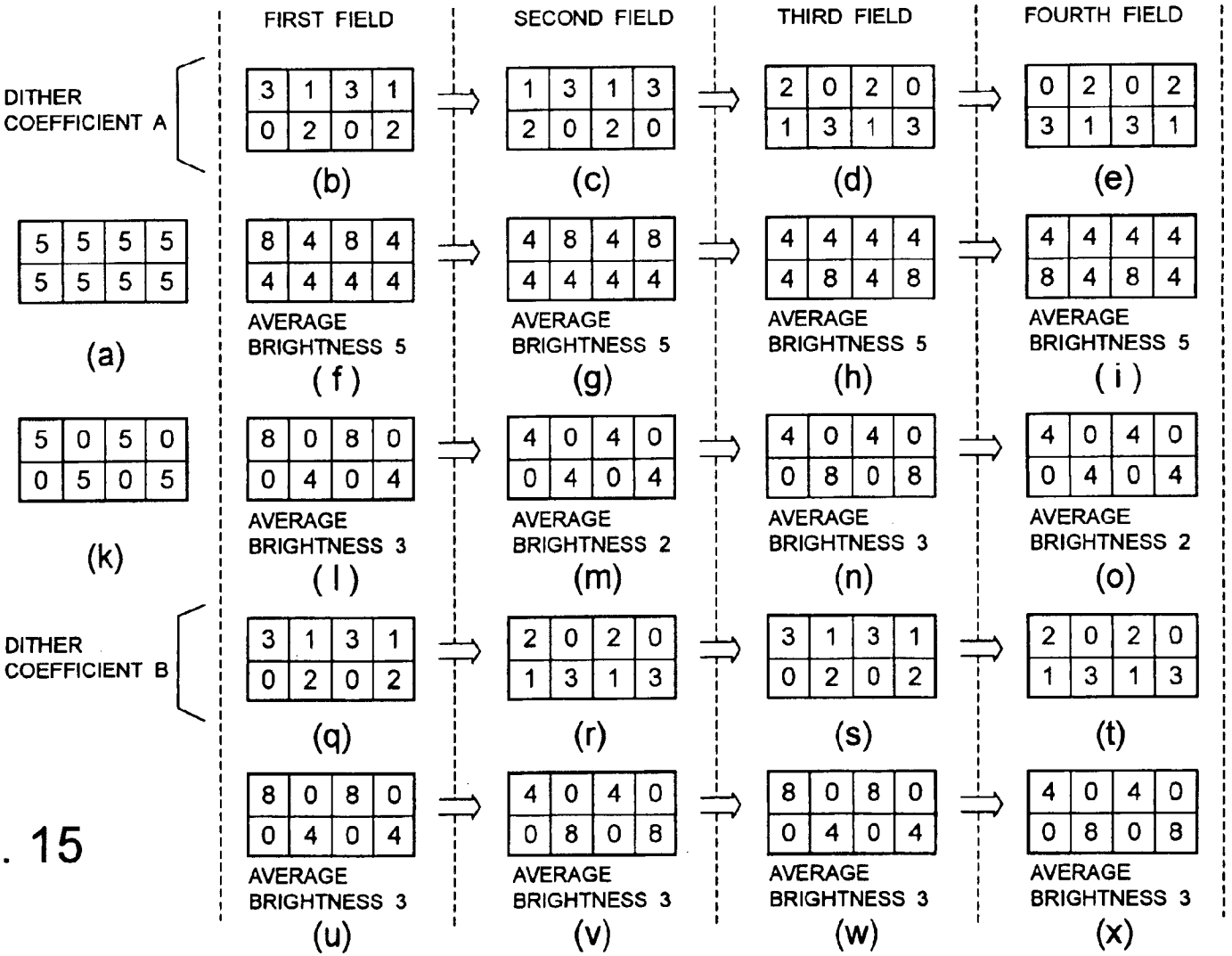
FIG. 15 is an explanatory diagram illustrating the operation of the dithering circuit 24 shown in FIG. 14.

FIG. 15 is a view illustrating an example of the operation of the dithering circuit 24 shown in FIG. 14.

First, when a so-called low-frequency video signal is supplied which allows all the pixel data in the two-row by four-column pixel block shown in the part (a) of FIG. 15 to represent a brightness level of "5", the low-frequency dither coefficients "A" which change as shown in the part (b) to the part (e) of FIG. 15 are added to each of the pixel data in the two-row by four-column pixel block. This allows for providing the dithered pixel data DP shown in the part (f) to the part (i) of FIG. 15. In this case, the average value of the respective dithered pixel data DP shown in the part (f) to the part (i) of FIG. 15 is "5" in the two-row by four-column pixel block, with no variation being present in the average brightness level over the first to the fourth fields. Therefore, no flicker will be produced.

However, suppose that dithering is performed, using the low-frequency dither coefficients "A" shown in the part (b) to the part (e) of FIG. 15, on a so-called high-frequency video signal having pixel data indicative of mixed brightness levels of "5" and "0" in the two-row by four-column pixel block as shown in the part (k) of FIG. 15. In this case, flicker would be produced. That is, adding the low-frequency dither coefficients "A" shown in the part (b) to the part (e) of FIG. 15 to the pixel data shown in the part (k) of FIG. 15 provides the dithered pixel data DP as shown in FIGS. 15(*l*) to 15(*o*). At this time, the average value of the respective dithered pixel data DP in the first and third fields is "3" in the two-row by four-column pixel block, however, the average value of the respective dithered pixel data DP in the second and fourth fields is "2" in the two-row by four-column pixel block. Accordingly, the variation in the average brightness level over the first to the fourth fields in the two-row by four-column pixel block will result in flicker.

In this context, the dithering circuit 24 shown in FIG. 14 performs dithering, using the high-frequency dither coefficients "B" as shown in the part (q) to the part (t) of FIG. 15, on the high-frequency video signal shown in the part (k) of FIG. 15. As shown in the part (u) to the part (x) of FIG. 15, such dithering provides the dithered pixel data DP having an average value of "3" in the two-row by four-column pixel block. This causes no variation in the average brightness level in the two-row by four-column pixel block over the first to the fourth fields, allowing a good flicker-free image to be displayed.

Furthermore, the aforementioned embodiment allows gray scale processing to be performed on an input video signal only when the input video signal is lower in frequency than a predetermined frequency. However, the aforementioned gray scale processing may not be performed when the input video signal is lower in frequency than the predetermined frequency, but may be performed only when the input video signal is higher in frequency than the predetermined frequency. At this time, it is necessary to choose the dither coefficients that can prevent flicker from being produced.

This application is based on Japanese Patent Applications Nos. 2002-376418 and 2002-371878 which are herein incorporated by reference.

What is claimed is:

1. A gray scale processing system for increasing a number of gray scale levels of image brightness expressed by a video signal, comprising:

a frequency detector for detecting a frequency of said video signal;

a gray scale processing circuit for performing gray scale processing on said video signal; and a gray scale process control component for controlling an operation of said gray scale processing circuit in response to said frequency wherein said gray scale processing circuit comprises:

a first dither coefficient generation circuit for generating a first dither coefficient;

a second dither coefficient generation circuit for generating a second dither coefficient different from said first dither coefficient; and a dither adder for delivering a dithered video signal obtained by adding said first dither coefficient to said video signal when said frequency is lower than a predetermined frequency, while delivering a dithered video signal obtained by adding said second dither coefficient to said video signal when said frequency is higher than said predetermined frequency.

2. The gray scale processing system according to claim 1, wherein said gray scale processing circuit comprises an error diffusion circuit and/or a dithering circuit.

3. The gray scale processing system according to claim 1, wherein said gray scale process control component controls said gray scale processing circuit so as to perform said gray scale processing on said video signal when said frequency is lower than a predetermined frequency, while controlling said gray scale processing circuit so as to deliver said video signal as it is when said frequency is higher than said predetermined frequency.

4. A gray scale processing system for increasing a number of gray scale levels of image brightness expressed by a video signal, comprising:

a frequency detector for detecting a frequency of said video signal, a noise adding circuit for obtaining a noise added video signal by adding a noise signal to said video signal, a gray scale processing circuit for performing gray scale processing on said video signal, and a control component for controlling an operation of each of said gray scale processing circuit and said noise adding circuit in response to said frequency wherein said gray scale processing circuit comprises:

a first dither coefficient generation circuit for generating a first dither coefficient;

a second dither coefficient generation circuit for generating a second dither coefficient different from said first dither coefficient; and a dither adder for delivering a dithered video signal obtained by adding said first dither coefficient to said video signal when said frequency is lower than a predetermined frequency, while delivering a dithered video signal obtained by adding said second dither coefficient to said video signal when said frequency is higher than said predetermined frequency.

5. The gray scale processing system according to claim 4, wherein said gray scale processing circuit comprises an error diffusion circuit and/or a dithering circuit.

6. The gray scale processing system according to claim 4, wherein said control component controls said gray scale processing circuit so as to perform said gray scale processing on said video signal when said frequency is lower than a predetermined frequency, while controlling said gray scale processing circuit so as to deliver said video signal as it is when said frequency is higher than said predetermined frequency.

7. The gray scale processing system according to claim 4, wherein said control component controls said noise adding circuit so as to add said noise signal to said video signal when said frequency is lower than a predetermined frequency, while controlling said noise adding circuit so as to deliver said video signal as it is when said frequency is higher than said predetermined frequency.

8. A display device with a gray scale processing system for increasing the number of gray scale levels of image brightness expressed by a video signal, comprising:

a frequency detector for detecting a frequency of said video signal;

a gray scale processing circuit for performing gray scale processing on said video signal to generate a gray scaled video signal, a display component for displaying an image in response to said gray scaled video signal; and a gray scale process control component for controlling an operation of said gray scale processing circuit in response to said frequency wherein said gray scale processing circuit comprises:

a first dither coefficient generation circuit for generating a first dither coefficient;

a second dither coefficient generation circuit for generating a second dither coefficient different from said first dither coefficient; and a dither adder for delivering a dithered video signal obtained by adding said first dither coefficient to said video signal when said frequency is lower than a predetermined frequency, while delivering a dithered video signal obtained by adding said second dither coefficient to said video signal when said frequency is higher than said predetermined frequency.

9. The display device according to claim 8, wherein said gray scale processing circuit comprises an error diffusion circuit and/or a dithering circuit.

10. The display device according to claim 8, wherein said gray scale process control component controls said gray scale processing circuit so as to perform said gray scale processing on said video signal when said frequency is lower than a predetermined frequency, while controlling said gray scale processing circuit so as to deliver said video signal as it is when said frequency is higher than said predetermined frequency.

* * * * *